United States Patent [19]

Perkins

[11] Patent Number: 4,531,785

[45] Date of Patent: Jul. 30, 1985

[54] ROLLER SKATE WHEEL AND MOUNTING ASSEMBLY

[76] Inventor: Kenneth R. Perkins, 42 Christy Rd., Gales Ferry, Conn. 06335

[21] Appl. No.: 445,254

[22] Filed: Nov. 29, 1982

[51] Int. Cl.[3] ..... A63C 17/22

[52] U.S. Cl. ..... 301/5.7; 301/63 PW; 301/111; 384/537

[58] Field of Search ..... 301/5.7, 5.3, 9 R, 111, 301/112, 63 PW, 108 SC, 7, 121, 122; 308/191, DIG. 11, 190, 189 R, DIG. 3; 280/87.04 A, 87.04 R; 384/544, 546

[56] References Cited

U.S. PATENT DOCUMENTS

| | | | |
|---|---|---|---|
| 2,377,855 | 6/1945 | Ambrosini | 301/5.7 |
| 2,476,193 | 7/1949 | Hirschmugl | 301/5.7 |
| 2,510,659 | 6/1950 | Ristow | 308/191 |
| 2,547,796 | 4/1951 | Swenson | 301/5.7 X |
| 2,612,410 | 9/1952 | Deschenes | 301/5.7 |
| 2,652,285 | 9/1953 | Negri | 301/5.7 |
| 3,024,033 | 3/1962 | Skaggs | 280/11.28 |
| 3,626,774 | 12/1971 | Schon | 301/5.7 |
| 3,860,293 | 1/1975 | Labeda | 301/5.7 |
| 3,912,332 | 10/1975 | Jones | 301/5.7 |
| 3,933,397 | 1/1976 | Hood | 308/180 |
| 4,114,952 | 9/1978 | Kimmell | 301/63 PW |

*Primary Examiner*—Robert B. Reeves
*Assistant Examiner*—Russell D. Stormer
*Attorney, Agent, or Firm*—Prutzman, Kalb, Chilton & Alix

[57] ABSTRACT

A roller skate wheel assembly is disclosed comprising a skate axle subassembly and a detachable skate wheel with the subassembly having an anti-friction bearing unit securely mounted on the axle and the skate wheel having a hub portion with an annular insert to snugly receive the bearing unit and a detachable locking ring to engage the wheel insert and secure the skate wheel to the bearing unit.

23 Claims, 3 Drawing Figures

ROLLER SKATE WHEEL AND MOUNTING ASSEMBLY

BACKGROUND OF THE INVENTION

This invention relates to roller skates and more particularly to a new and improved roller skate wheel and mounting assembly.

Roller skating has become an increasingly popular sport and recreational activity and in addition to simply skating around a roller-skating rink, people engage in dancing, racing, performing, and other activities on skates. It is common, especially in the larger cities, to see people roller-skating through the streets and parks.

With this increase of skating activity, skating equipment has become somewhat specialized for the various activities. For example, a different type of skate wheel is utilized for dancing or performing as compared to speed-racing. Also, the material comprising the skating surface affects the type of skate wheel utilized, e.g., one type of wheel is more suitable for skating on concrete than on wood. Accordingly, it is desirable for a skater to be able to change skating wheels depending upon the skating activity and the skating surface.

In prior roller skate wheels, the anti-friction bearing units are mounted within the wheel so that the wheel and bearing units must be removed from the skates in order to change skate wheels. Typically, the wheel and bearings are connected together as a single unit, thereby necessitating a set of bearings for each wheel. Such a wheel and bearing assembly is usually fixed to the axle by a threaded fastener and therefore requires a wrench to change skate wheels.

SUMMARY OF THE INVENTION

A roller skate wheel and assembly is disclosed as comprising a skate axle subassembly having an axle mounted to the support housing of a roller skate with the antifriction bearing units securely mounted to the axle. The skate wheel is detachably mounted to the bearing unit and comprises a hub portion with a central bore to receive the bearing unit, a cylindrical tire portion about the hub portion, and a removable locking ring for securing the skate wheel on the bearing unit. The central bore has an annular insert mounted therein with a cylindrical recess to slidably receive and seat the bearing unit. A flange portion at the inner end of the cylindrical recess abuts the bearing unit to determine its axial position within the wheel. An annular groove at the outer end of the cylindrical recess engages the locking ring to secure the wheel in place by maintaining the bearing unit between the locking ring and flange. The insert has a plurality of radially extending ridges which extend into the tire portion of the skate wheel.

An object of the present invention is to provide a new and improved skate wheel and assembly that allows quick and easy interchange of skate wheels without the necessity of each skate wheel having its own set of anti-friction bearings.

A further object of the invention is to provide a skate wheel assembly wherein the bearing units are securely mounted on the axles and remain on the axles during interchange of skate wheels.

A further object of the invention is to provide a skate wheel having an annular insert to facilitate mounting about the bearing units and interchangeability of skate wheels on the bearing units.

A still further object of the invention is to provide a molded plastic skate wheel having a metallic annular insert for mounting the skate wheel which allows the utilization of relatively softer types of plastic material.

A still further object of the invention is to provide a roller skate wheel and assembly that is economical to manufacture, durable in use and refined in appearance.

DESCRIPTION OF THE PREFERRED EMBODIMENT

Figure 1:
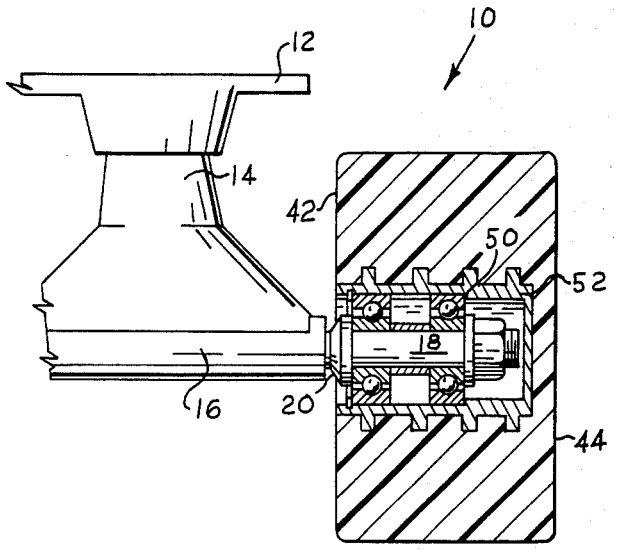
FIG. 1 is an elevational view, partly in section and partly broken away, of the present invention mounted to the support structure of a roller skate.

The roller skate wheel assembly of this invention is generally designated by the numeral 10 and is shown in FIG. 1 mounted to the supporting structure of a roller skate. The supporting structure of the roller skate includes a support plate 12 supported upon a downwardly projecting truck 14. An axle housing 16 is secured to the lower side of truck 14 with a horizontally extending axle 18 projecting therefrom. The axle 18 is cylindrical in shape with a retainer or stop portion 20 to prevent inward movement of the wheel toward the truck 14.

Figure 3:
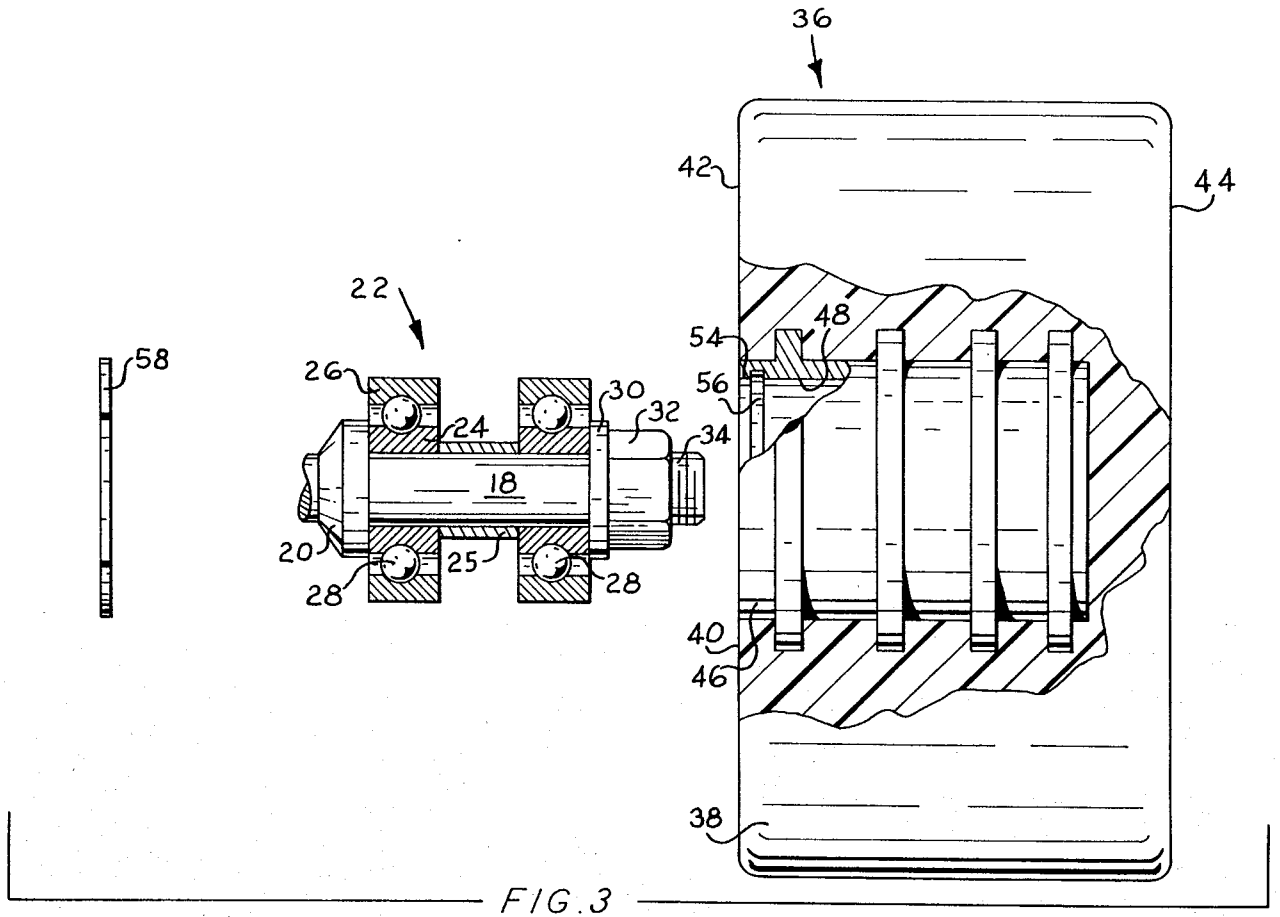
FIG. 3 is an enlarged exploded view, partly broken away and partly in section, of the view of FIG. 1.

As shown in FIG. 3, an anti-friction bearing unit 22 is mounted about axle 18 in abutting contact with retainer 20. Bearing unit 22 comprises a plurality of ball bearings 28 between an inner race 24 and an outer race 26 and a spacer sleeve 25, and is held tightly against retainer 20 by washer 30 and nut 32 threadably engaging the threaded end 34 of axle 18. Thus, bearing unit 22 is securely mounted upon axle 18 between retainer 20 and nut 32 with retainer 20 determining the axial position of bearing unit 22.

Roller skate wheel 36 is generally comprised of a cylindrical tire portion 38 about a hub portion 40 with opposing sides 42, 44.

Hub portion 40 has a central bore to receive and seat bearing unit 22, and in the embodiment of FIG. 3, the hub portion includes a wheel insert 46 integrally connected to the hub portion 40 and tire portion 38. Wheel insert 46 has a cylindrical recess 48 to snugly receive bearing unit 22. Recess 48 has an annular flange or abutment shoulder 50 at its inner end 52 to abut bearing unit 22 as shown in FIG. 1 and an annular groove 56 at its outer end 54 to receive a spring clip or locking ring 58 with the distance between the spring clip 58 and the flange 50 being compatible to the axial length of bearing unit 22. Preferably, spring clip 58 is a resilient compressable split ring which retentively engages annular groove 56 and abuts bearing unit 22 to detachably secure skate wheel 36 to the bearing unit 22. Thus, bearing unit 22 is snugly received within recess 48 of insert 46 and held between locking ring 58 and annular flange 50.

Figure 2:
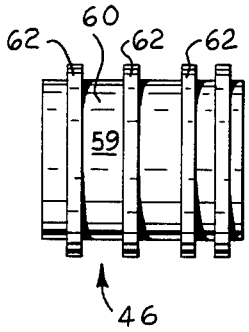
FIG. 2 is an elevational view of the wheel insert of the present invention.

Referring to FIG. 2, wheel insert 46 has an outer cylindrical surface 59 with a plurality of radially extending ridges or rings 62 defining circumferential valleys 60 therebetween. Skate wheel 36 is preferably made of molded plastic material with a metal wheel insert 46 such that the plastic material is molded between ridges 62 to firmly secure the insert within the wheel. Wheel insert 46 is preferably made of aluminum with the radially extending rings 62 also providing additional strength. Wheel insert 46 allows the utilization of relatively softer plastic material for the skate wheel because the spring clip 58 cooperates with the annular groove 56 of the insert 46 rather than the soft plastic material which would be unable to satisfactorily retain the spring clip 58.

As shown in FIG. 1, the outward side 44 of wheel 36 is a solid continuous surface to prevent dirt and foreign matter from getting into the bearing unit 22 and to also provide a pleasing, aesthetic configuration.

In operation, roller skate wheels 36 are easily interchangeable by simply removing locking ring 58 and sliding the skate wheel 36 from bearing unit 22. Spring clip 58 is easily removed from engagement with groove 56 by compression of its ends. Bearing unit 22 remains securely mounted on axle 18 while another wheel is slideably inserted over the bearing unit 22 and securely attached thereon by reinsertion of spring clip 58 in groove 56.

Accordingly, an economical skate wheel is provided that does not require a separate set of anti-friction bearings for each wheel, but rather utilizes one set of bearings securely mounted on the skate axle. Interchangeability of wheels is quickly and easily accomplished. Additionally, wheel insert 46 allows the utilization of the spring clip type of detachable securement with a softer plastic material in the skate wheels since it provides a strong wear-resistent engagement groove.

Thus it can be seen that this device accomplishes at least all of its stated objectives.

What is claimed is:

1. A roller skate wheel assembly comprising:

a skate axle subassembly having an axle mounted to a roller skate support housing and a premounted anti-friction bearing unit securely mounted on said axle independent of the mounting of a skate wheel on said bearing unit to permit removal of the skate wheel while the bearing unit remains securely mounted on said axle, and a skate wheel detachably mounted to said bearing unit having, a hub portion with a central bore adapted to be slidably mounted on a bearing unit securely mounted on a skate axle, said hub portion being slidably mounted on said bearing unit with said bearing unit being inserted and seated within said central bore, said central bore having first and second ends with said first end being disposed toward said support housing, a cylindrical tire portion about said hub portion, and means for detachably securing said skate wheel to said skate axle subassembly independent of the mounting of said premounted bearing unit to said axle so that said skate wheel is removable and replaceable without removal of said bearing unit from said axle, said means for detachably securing said skate wheel to said bearing unit comprising an annular groove within said central bore adjacent said first end and a removable locking ring receivable in said groove, said locking ring being mounted in engagement with said groove intermediate said bearing unit and said support housing to retentively abut said bearing unit to retain the skate wheel on said bearing unit.

2. The assembly of claim 1 wherein said skate wheel has opposing first and second sides with said central bore opening from said first side and said second side being a continuous surface.

3. The assembly of claim 1 wherein said axle has a threaded outer end and an inner end with a retaining portion, and a threaded fastener threadably engages said outer end, said threaded fastener securely holding said bearing unit against said retaining portion.

4. A roller skate wheel for mounting on a skate axle subassembly of the type having a bearing unit securely mounted on the axle, comprising;

a hub portion;

a cylindrical tire portion about said hub portion with said tire and hub portions forming opposing first and second sides of the skate wheel, and an annular insert mounted within said hub having, a central cylindrical recess to snugly receive a bearing unit assembly, said recess having first and second ends with said first end opening out at said first side of the skate wheel, an abutment shoulder at said second end of said recess adapted to abut the bearing unit to determine the axial position of said bearing unit within said recess, and a plurality of radially extending ridges on the outer surface of said insert, and said hub and tire portions being integrally formed about said annular insert between said ridges to firmly secure said tire and hub portions to said insert with said second side of said skate wheel being a continuous solid surface to prevent foreign matter from entering said recess.

5. The skate wheel of claim 4 further including means for detachably securing said skate wheel to the bearing unit.

6. The skate wheel of claim 5 wherein said securing means comprises an annular groove within said recess at said first end and a removable locking ring in engagement with said groove adapted to retentively abut a bearing unit between said retainer portion and said locking ring.

7. The skate wheel of claim 6 wherein said locking ring is a resilient compressible split ring.

8. The skate wheel of claim 4 wherein said retainer portion comprises an annular flange within said central cylindrical recess.

9. The skate wheel of claim 4 wherein said insert has an outer cylindrical surface and said ridges comprise a plurality radially extending rings on said outer surface.

10. The skate wheel of claim 9 wherein said tire portion engages and cooperates with said rings to securely mount said insert to said tire portion.

11. The skate wheel of claim 4 wherein said tire and hub portion are integrally constructed of molded plastic material being molded about said annular insert with said insert being constructed of metal.

12. The skate wheel of claim 11 wherein said plastic material is molded between said radially extending ridges.

13. A roller skate wheel assembly comprising:

a skate axle subassembly having an axle mounted to a roller skate support housing and a premounted anti-friction bearing unit securely mounted on said axle independent of the mounting of a skate wheel on said bearing unit to permit removal of the skate wheel while the bearing unit remains securely mounted on said axle, and a skate wheel detachably mounted to said bearing unit having, first and second sides with said first side being a continuous surface, a hub portion with a central bore opening from said second side of said skate wheel and adapted to be slidably mounted on a bearing unit securely mounted on a skate axle, said hub portion being slidably mounted on said bearing unit with said bearing unit being inserted and seated within said central bore, a cylindrical tire portion about said hub portion, and means for detachably securing said skate wheel to said skate axle subassembly independent of the mounting of said premounted bearing unit to said axle so that said skate wheel is removable and replaceable without removal of said bearing unit from said axle.

14. The assembly of claim 13 wherein said central bore has first and second ends with said first end being disposed toward said support housing, and said means for detachably securing said skate wheel to said bearing unit comprises an annular groove within said central bore adjacent said first end and a removable locking ring receivable in said groove, said locking ring being mounted in engagement with said groove intermediate said bearing unit and said support housing to retentively abut said bearing unit to retain the skate wheel on said bearing unit.

15. The assembly of claim 13 wherein said hub comprises a wheel insert having a cylindrical recess with inner and outer ends to snugly receive and seat said bearing unit and an abutment shoulder at said inner end to abut said bearing unit to seat said bearing unit in said recess and limit inward axial movement of said bearing unit into said recess.

16. The assembly of claim 15 wherein said means for detachably securing said skate wheel to said bearing unit comprises an annular groove in said cylindrical recess adjacent said outer end and a removable locking ring in engagement with said groove to retentively abut said bearing unit, said bearing unit being held between said locking ring and said flange portion.

17. The assembly of claim 16 wherein said locking ring is a resilient compressible split ring.

18. A roller skate wheel assembly comprising:

a skate axle subassembly having an axle mounted to a roller skate support housing and a premounted anti-friction bearing unit securely mounted on said axle independent of the mounting of a skate wheel on said bearing unit to permit removal of the skate wheel while the bearing unit remains securely mounted on said axle, and a skate wheel detachably mounted to said bearing unit having, a hub portion adapted to be slidably mounted on a bearing unit securely mounted on a skate axle, said hub portion being slidably mounted on said bearing unit with said bearing unit being inserted and seated within said hub portion, said hub portion comprising a wheel insert having a plurality of radially extending ridges and a cylindrical recess with inner and outer ends to snugly receive and seat said bearing unit and an abutment shoulder at said inner end to abut said bearing unit to seat said bearing unit in said recess and limit inward axial movement of said bearing unit into said recess, a cylindrical tire portion about said hub portion, and means for detachably securing said skate wheel to said skate axle subassembly independent of the mounting of said premounted bearing unit to said axle so that said skate wheel is removable and replaceable without removal of said bearing unit from said axle.

19. The assembly of claim 18 wherein said tire portion is molded plastic material and said insert is metal with said plastic material being molded between said ridges.

20. The assembly of claim 18 wherein said radially extending ridges are annular rings.

21. The subassembly of claim 18 wherein said means for detachably securing said skate wheel to said bearing unit comprises an annular groove in said cylindrical recess adjacent said outer end and a removable locking ring in engagement with said groove to retentively abut said bearing unit, said bearing unit being held between said locking ring and said flange portion.

22. The assembly of claim 21 wherein said locking ring is a resilient compressible split ring.

23. The assembly of claim 18 wherein said skate wheel has opposing first and second sides with said central bore opening from said first side and said second side being a continuous surface.

* * * * *